US005775463A

United States Patent [19]

Alberts

[11] Patent Number: 5,775,463

[45] Date of Patent: Jul. 7, 1998

[54] TOEBOARD SYSTEM FOR A DECKPLATE

[75] Inventor: Robert A. Alberts, Wyomissing Hills, Pa.

[73] Assignee: Alumax Extrusions, Inc., Cressona, Pa.

[21] Appl. No.: 683,588

[22] Filed: Jul. 15, 1996

[51] Int. Cl.[6] ..... A47L 3/02

[52] U.S. Cl. ..... 182/113; 182/112

[58] Field of Search ..... 182/112, 113, 182/119, 222; 256/65; 403/381

[56] References Cited

U.S. PATENT DOCUMENTS

| | | | |
|---|---|---|---|
| 867,274 | 10/1907 | Humphries | 182/113 X |
| 2,136,696 | 11/1938 | Lamb | 182/113 |
| 2,332,477 | 10/1943 | Thornley | 182/113 X |
| 2,706,662 | 4/1955 | Brown | 182/113 |
| 3,480,257 | 11/1969 | Bourn et al. | 182/113 X |
| 3,785,602 | 1/1974 | Juculano | 182/113 X |
| 3,848,854 | 11/1974 | De Barbieri | 182/113 X |
| 3,853,203 | 12/1974 | Werner et al. . | |
| 4,253,548 | 3/1981 | Beeche . | |
| 4,301,627 | 11/1981 | Wilson . | |
| 4,475,625 | 10/1984 | Clements . | |
| 4,503,932 | 3/1985 | Hilton . | |
| 4,620,612 | 11/1986 | Enoki et al. . | |
| 4,749,060 | 6/1988 | Vandelinde . | |
| 4,766,975 | 8/1988 | Whitson . | |
| 5,107,959 | 4/1992 | Lubinski | 182/113 X |
| 5,295,557 | 3/1994 | Taylor | 182/113 X |
| 5,299,653 | 4/1994 | Nebel | 182/113 X |
| 5,325,649 | 7/1994 | Kajiwara | 403/381 X |
| 5,499,886 | 3/1996 | Short et al. | 403/381 |
| 5,531,539 | 7/1996 | Crawford | 403/381 |
| 5,558,312 | 9/1996 | Brennan | 182/113 X |

*Primary Examiner*—Alvin C. Chin-Shue
*Assistant Examiner*—Richard M. Smith
*Attorney, Agent, or Firm*—Panitch Schwarze Jacobs & Nadel, P.C.

[57] ABSTRACT

A toeboard system for a deckplate is comprised of a toeboard member that includes an upper section extending above the deckplate, a central section having a deck opening configured to receive a side edge of the deckplate and a lower section. The toeboard system further includes a spacer member having a lower deck contact surface, the spacer member being fastened to the toeboard member below the deck opening of the central section by a mating opening on one member and a mating projection on the other member. The upper section of the toeboard member has an upper deck contact surface that is substantially flat and extends substantially perpendicular to a sidewall of a central section of the toeboard, an inboard surface which is substantially perpendicular to and intersecting with the upper deck contact surface and an outboard surface which is arcuate and convergent with the inboard surface at an edge remote from the upper deck contact surface. The spacer member can be of various sizes to adjust the size of the deckplate opening and has a lower deck contact surface which can support some of the load carried by the deckplate. The spacer can be welded to the toeboard member and either or both can be fixedly joined to the deckplate.

7 Claims, 5 Drawing Sheets

TOEBOARD SYSTEM FOR A DECKPLATE

FIELD OF THE INVENTION

The present invention relates to the field of toeboards for deckplates used to construct catwalks, walkways, mezzanines, scaffolds and similar structures.

BACKGROUND OF THE INVENTION

As is well known in the prior art, deckplates used in the construction of work platforms or other suspended walkways are generally provided with toeboard systems. These toeboard systems are intended to prevent tools or other objects from being knocked off the edges of such walkways or platforms. Furthermore, these toeboard systems may prevent a person from slipping off the edge of a platform, such as underneath a railing system that has an open space between the lowest rail and the deckplate.

There are a number of toeboard designs known in the prior art. These toeboard systems generally include a guard wall which extends above the deckplate to which the toeboard is mounted and some means for fastening the guard wall to the deckplate near a side edge of the deckplate. The guard walls of these prior art toeboard systems are typically constructed as a flat, relatively thin piece of material, such as sheet of metal or plastic, joined at a flat surface to the deckplate so that the narrowest cross-section of the guard wall extends parallel to the top surface of the deckplate. Generally, the toeboard systems of the prior art perform only the function of preventing objects from falling off the edges and are incapable of bearing or supporting any portion of the loading on the deckplates.

SUMMARY OF THE INVENTION

Briefly stated, in a first aspect, the present invention is a toeboard system for a deckplate which is comprised of a toeboard member that includes an upper section extending above the deckplate, a central section having a deck opening configured to receive a side edge of the deckplate and a lower section. The toeboard system further includes a spacer member having a lower deck support surface, the spacer member being fastened to the toeboard member below the deck opening of the central section.

In a second aspect, the invention is a toeboard for a deckplate which includes an upper section having an upper deck contact surface that is substantially flat and extends substantially perpendicular to a sidewall of a central section of the toeboard, an inboard surface which is substantially perpendicular to and intersecting with the upper deck contact surface and an outboard surface which is arcuate and convergent with the inboard surface at an edge of the upper section remote from the upper deck contact surface. The toeboard also includes a central section which has a deck opening configured to receive an edge section of the deckplate and a lower section which has a substantially flat base surface that extends along a bottom edge of the lower section.

In a third aspect, the invention is a combination comprised of a deckplate, a toeboard having an opening along a side facing the deckplate, the opening receiving one side edge of the deckplate, and a separate spacer member fastened to the toeboard and including a lower deck contact surface abutting a bottom surface of the deckplate.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
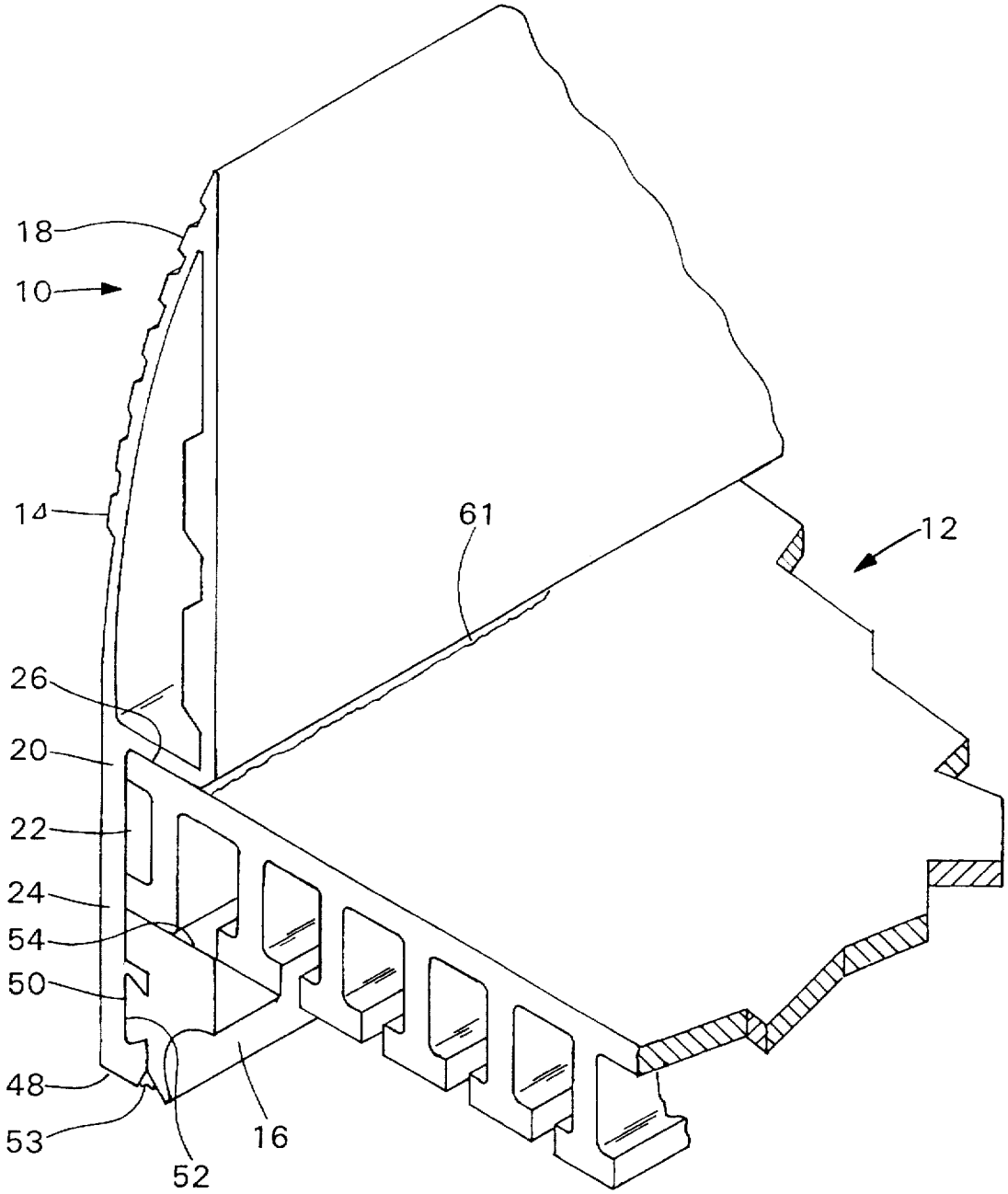
FIG. 1 is a partial perspective view of a toeboard system according to a first preferred embodiment of the present invention, shown assembled to a conventional deckplate.

Certain terminology is used in the following description for convenience only and is not limiting. The words "right", "left", "lower" and "upper" designate directions in the drawing to which reference is made. The words "inner" and "outer" refer to directions toward and away from, respectively, the geometrical centers of the toeboard, spacer and/or deckplate, and designated parts thereof. The words "inboard" and "outboard" refer to directions toward and away from, respectively, the geometrical center of the deckplate. The terminology includes the words above specifically mentioned, derivatives thereof and words of similar import.

Referring now to the drawings in detail, wherein like numerals are used to indicate like elements throughout, there is shown in FIGS. 1–4 a first preferred embodiment of a toeboard system 10 for a deckplate 12. The toeboard system 10 comprises a toeboard member 14 and a spacer member 16. The toeboard member 14 includes an upper section 18 extending above the deckplate 12, a central section 20 which includes a deck opening 22 configured to receive and be disposed about a side edge 13 of the deckplate 12 and a lower section 24.

Figure 2:
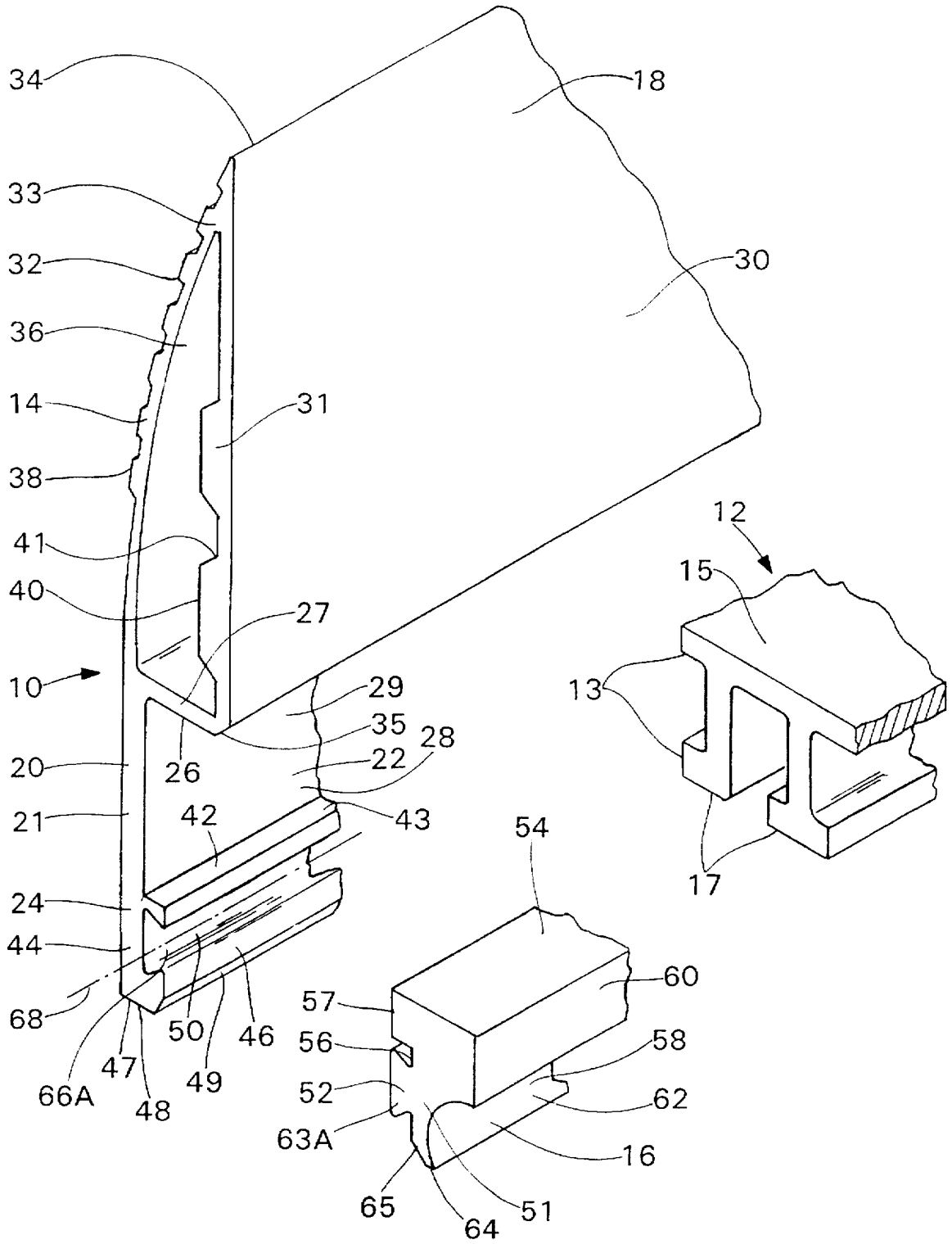
FIG. 2 is a partial perspective exploded view of the toeboard system of FIG. 1.

Referring to FIG. 2 in detail, the upper section 18 of the toeboard member 14 includes an upper deck contact surface 26 which is substantially flat and extends substantially perpendicular to a sidewall 28 of the central section 20 of the toeboard member 14. The upper section 18 also includes an inboard surface 30 which is substantially perpendicular to and intersecting with the upper deck contact surface 26 and an outboard surface 32 which is arcuate and convergent with the inboard surface 30 at an edge 34 of the upper section 18 which is remote from the upper deck contact surface 26. The upper section 18 of the toeboard member 14 further includes a weld surface 35 disposed between the upper deck contact surface 26 and the inboard surface 30, the purpose of which is explained below.

Preferably, the upper section 18 of the toeboard member 14 is constructed having a base wall 27, an inner wall 31 and an outer wall 33, with the three walls enclosing a cavity 36. With such a construction, the upper contact surface 26 is a surface of the base wall 27, the inboard surface 30 is a surface of the inner wall 31 and the outboard surface 32 is a surface of the outer wall 33. However, it is within the scope of the present invention to construct the upper section 18 of the toeboard member 14 with a solid, somewhat triangular cross-section (not shown) without cavity 36, so that the upper contact surface 26, the inboard surface 30 and the outboard surface 32 are all surfaces of the solid, generally triangular cross-section, or to construct the upper section 18 with a generally rectangular cross-section (not shown) with an additional top surface (not shown) or with any other desired cross-section. The present invention is intended to embrace all possible constructions of the upper section 14 of the toeboard member 14 which include at least an upper deck contact surface 26, an inboard surface 30 and an outboard surface 32.

In the preferred construction of the upper section 18 of the toeboard member 14, strengthening ribs 38 are included on the outboard surface 32 and strengthening ribs 40 are included on an inner surface 41 of the inner wall 31. The purpose of the strengthening ribs 38 and the strengthening ribs 41 is to prevent buckling and/or bending of the outer wall 33 and the inner wall 31, respectively, by a load applied to the upper section 18 of the toeboard member 14. However, it is within the scope of the present invention to construct the upper section 18 of the toeboard member 14 without strengthening ribs.

Referring again to FIG. 2 in detail, the central section 20 of the toeboard member 14 further includes a sidewall 28 extending downward from the upper section 18 and a ledge 42 extending substantially perpendicular to the sidewall 28. The deck opening 22 of the central section 20 of the toeboard member 14 is enclosed by an inner surface 29 of the sidewall 28 of the central section 20, an upper surface 43 of the ledge 42 of the central section 20 and the upper deck contact surface 26 of the upper section 18.

The lower section 24 of the toeboard member 14 has a sidewall 44 extending downward from the central section 20 which includes an inboard surface 46 and substantially flat base surface 48 extending along a bottom edge 47 of the lower section 24. The base surface 48 of the lower section 24 enables the toeboard system 10 to rest upon horizontal surfaces, such as, for example, a floor (not shown) or the top surface of end support beams (not shown). The lower section 24 further includes a mating opening 50 disposed into the inboard surface 46 of the sidewall 44. The mating opening 50 of the lower section 24 is configured to receive a projection 52 from the spacer member 16, as explained in more detail below. The mating opening 50 of the lower section 24 has a cross-section of a selected shape, which is preferably a dove-tail. The projection 52 of the spacer member 16 is disposed in the mating opening 50, has a cross-section of the selected, dove-tail shape and is sized to be received in and interlock with the mating opening 50, which is discussed in detail below. Although the preferred selected shape is a dove-tail, it is within the scope of the present invention to construct the mating opening 50 to have a cross-section of another shape, such as, for example, a circular cross-section (not shown) with a rectangular channel extending into the circle from the inboard surface 46. The lower section 24 of the toeboard member 14 further includes a chamfered weld surface 49 disposed between the inboard surface 46 and the base surface 48, the purpose of which is explained below.

Preferably, the toeboard member 14 of the toeboard system 10 is constructed of aluminum and manufactured in an extrusion process. However, it is within the scope of the present invention to construct the toeboard member 14 of another material, such as steel or a polymeric material and to manufacture the toeboard member 14 by another process, for example, casting, injection molding or stamping. The present invention is intended to embrace all feasible alternative materials for toeboard member 14 and all other manufacturing processes capable of constructing the toeboard member 14 as described in this disclosure.

Referring again to FIGS. 1–4 and in particular to FIG. 2, the toeboard system 10 for a deckplate 12 includes a spacer member 16 having a lower deck contact surface 54. The spacer member 16 is fastened to the toeboard member 14 below the deck opening 22 of the central section 20 of the toeboard member 14, as described in detail below. The spacer member 16 includes a projection 52 which extends from an outboard side 56 of the spacer member 16. Although the preferred selected shape of the projection 52 is a dove-tail, it is within the scope of the present invention to construct the projection 52 to have a cross-section of another shape, such as, for example, a circular cross-section (not shown) with a rectangular neck extending from the circle to the outboard surface 56. The spacer member 16 further includes a projection 57 extending from the outboard side 56 of the spacer member 16, the purpose of which is discussed below. The projection 57 of the spacer member 16 is configured to extend into the deck opening 22 of the central section 20 to reduce the width of the deck opening 22 when the spacer member 16 is assembled with the toeboard member 14.

Preferably, the spacer member 16 is constructed so that an inboard side 58 has a ledge 60 that is substantially perpendicular to the lower deck contact surface 54 and an arcuate surface 62 which extends below the ledge 60 and into a base surface 64. However, the inboard side 58 can be constructed as a straight wall (not shown), or some other configuration, without departing from the scope and spirit of the present invention. The spacer member 16 further includes a chamfered weld surface 65 disposed between the outboard side 56 and the base surface 64, the purpose of which is explained below.

Referring to FIGS. 1–4, prior to assembly with the toeboard member 14, the spacer member 16 is selected from a plurality of spacer members 16, 16', etc. of various sizes. Each of the spacer members 16 is sized to adjust the width w of the deck opening 22 in the central section 20 of the toeboard member 14 so that a distance d between the lower deck contact surface 54 of the spacer member 16 and the upper section 18, preferably the upper deck contact surface 26 of the upper section 18, of the toeboard member 14 is approximately equal to the thickness of one of a variety of deckplates 12, 12', etc. The spacer members 16 shown in FIGS. 1, 2, 3A and 4, when assembled in a toeboard system 10, adjust the width $w_1$ of the deck opening 22 to less than a maximum width, such that the distance $d_1$ between the lower deck contact surface 54 of the spacer member 16 and the upper deck contact surface 26 of the upper section 18 of the toeboard member 14 is approximately equal to the thickness $T_1$ of a deckplate 12 having a thickness less than a predetermined maximum. With a spacer member 16' sized as shown in FIG. 3B, the width $w_2$ of the deck opening 22 of the toeboard member 14 is equal to the maximum width and the spacer member 16' is utilized with a deckplate 12' having a thickness $T_2$ equal to the predetermined maximum thickness with which the toeboard system 10 can be used.

Figure 3B:
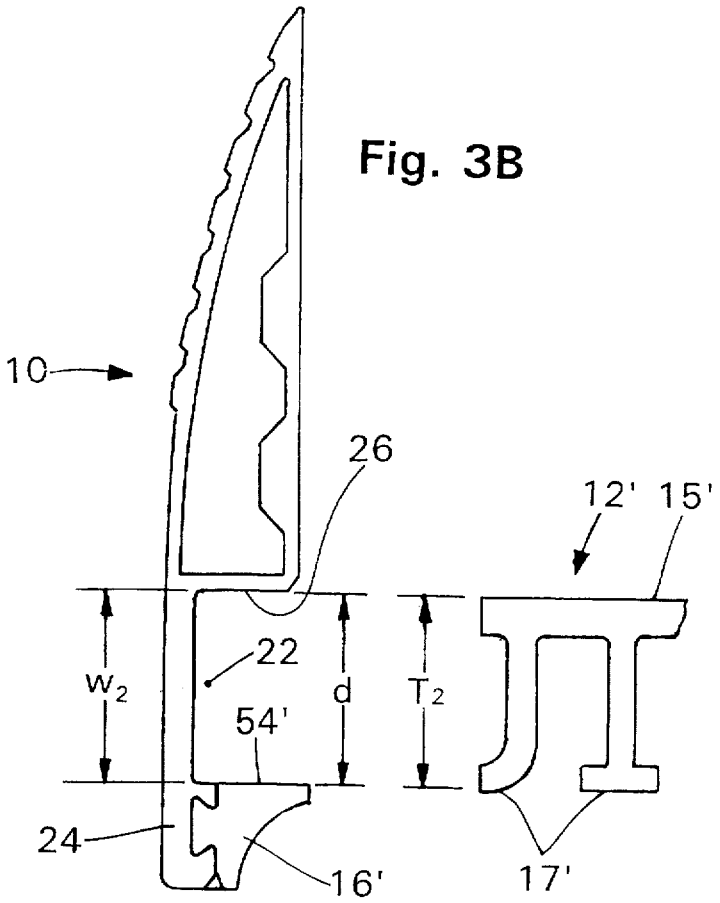
FIGS. 3A and 3B, collectively known as FIG. 3, are cross-sectional views of the toeboard system of the present invention, each view illustrating a different size spacer member for different size deckplates.
Figure 3A:
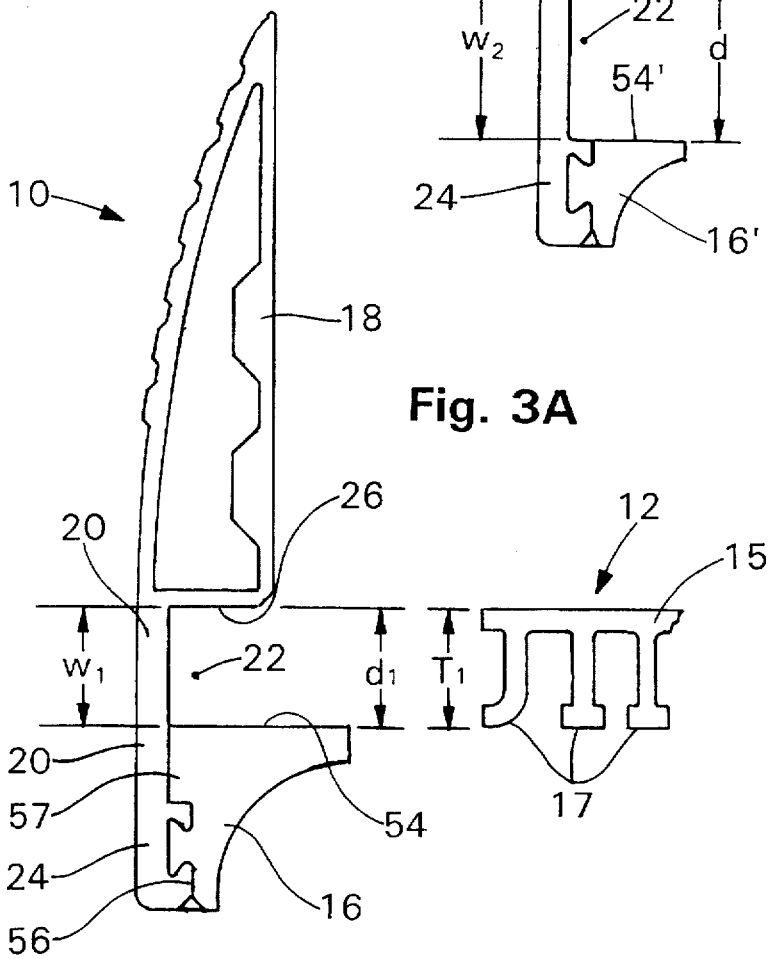

As shown in FIGS. 1, 2, 3A and 4, a spacer member 16 which is sized to adjust the width of the deck opening 22 of the central section 20 of the toeboard member 14 to a width $w_1$ which less than the maximum width preferably includes a projection 57 extending from the outboard side 56 of the spacer member 16. A spacer member 16' which is sized to adjust the width of the deck opening 22 of the central section 20 of the toeboard member 14 to a width $w_2$ equal to the maximum width is necessarily constructed without a projection 57, as shown in FIG. 3B. The projection 57 distributes part of the vertical loading on the deckplate 12 from deckplate 12 to the ledge 42 of the central section 22 of the toeboard member 14. However, a spacer member 16 (not shown) which is sized to adjust the width of the deck opening 22 of the central section 20 to less than the maximum width can be constructed without the projection 57 so that the upper portion of the space extends into the opening 22. A gap (not shown) will remain between the portion of the inboard side 56 of the spacer member 16 which projects upwardly into the deck opening 22 of the central section 20 and the sidewall 22 of the central section 20 of the toeboard member 14. In a toeboard system 10 having a spacer member 16 without the projection 57, all of the vertical loading from the deckplate 12 is transferred to the toeboard 14 through the projection 52 of the spacer member 16 in the mating opening 50. A spacer 16 having the projection 57 distributes part of the vertical load from the deckplate 12 through the projection 57 to the ledge 42 of the central section 20 of toeboard member 14, which reduces the shear stress on the projection 52 and on the portion of the lower section 24 below the mating opening 50 and enables a greater vertical load to be applied to the toeboard system 10 without failure.

Preferably, the spacer member 16 of the deckplate system 10 is constructed of aluminum and manufactured in an extrusion process. However, it is within the scope of the present invention to construct the spacer member 16 of another material, such as steel or a polymeric material and to manufacture the spacer member 16 by another process, for example, casting, injection molding or stamping. The present invention is intended to embrace all feasible alternative materials for the spacer member 16 and all other manufacturing processes capable of constructing the spacer member 16 as described in this disclosure.

Figure 4:
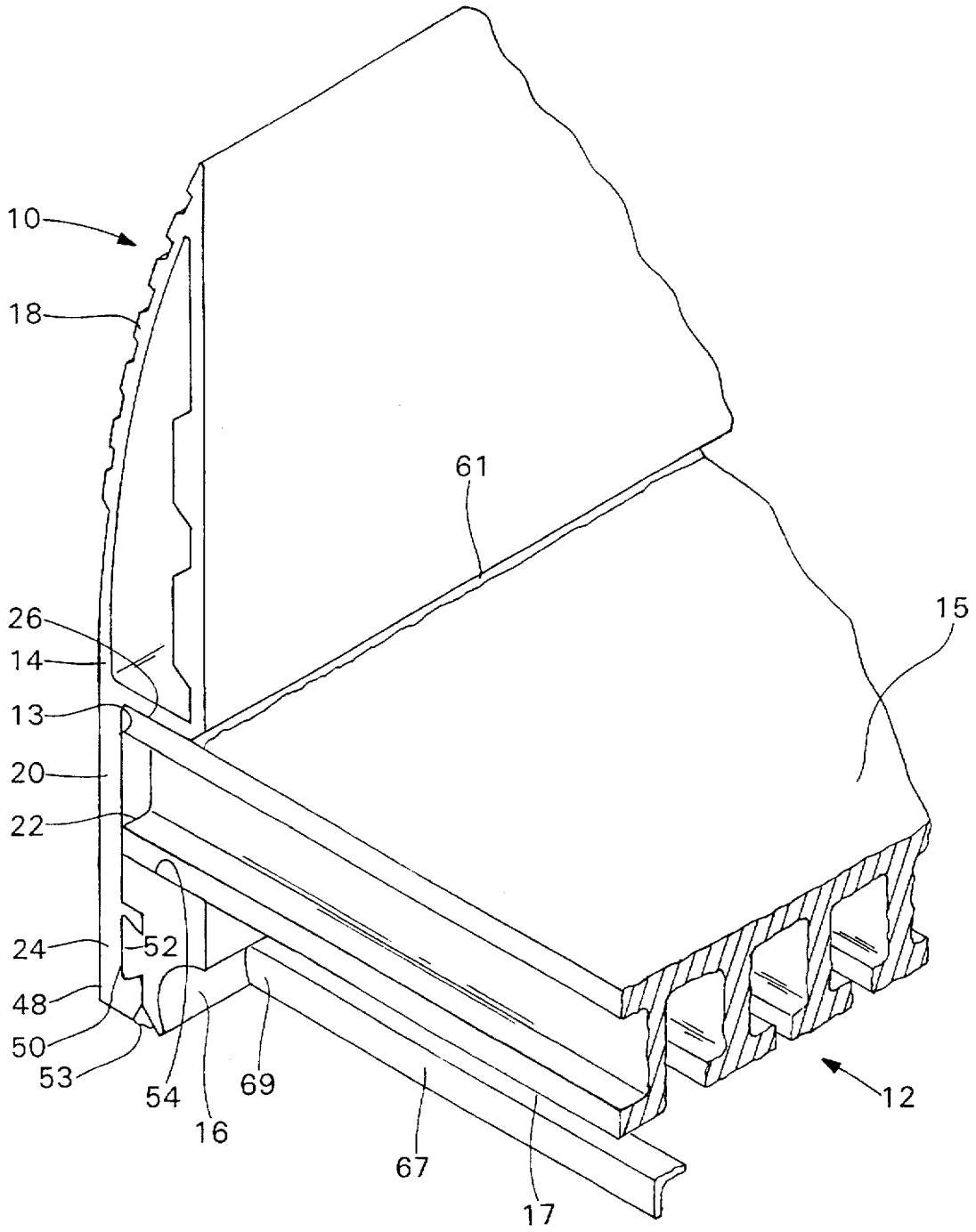
FIG. 4 is a partial perspective view of the first preferred embodiment of the toeboard system of the present invention, shown with an optional reinforcing member and a style of deckplate different than that shown in FIG. 1.

Referring to FIGS. 1–4, the first preferred embodiment of the toeboard system 10 for a deckplate 12 is assembled by fastening a selected spacer member 16, 16', etc. to the toeboard member 14 below the deck opening 22 of the central section 20 of the toeboard member 14. The spacer member 16 is fastened to the toeboard member 14 by disposing the projection 52 of the spacer member 16 within the mating opening 50 of the lower section 24 of the toeboard member 14. The projection 52 is disposed within the mating opening 50 by inserting an end face 63A or 63B (not shown) of the projection 52 of the spacer member 16 into one of the ends 66B (not shown) or 66A, respectively, of the mating opening 50 and then slidably displacing the projection 52 along the axis 68 of the mating opening 50. The spacer member 16 is secured to the toeboard member 14 by the interlocking structure of the projection 52 of the spacer member 16 disposed within the mating opening 50 of the lower section 24 of the toeboard member 14, which is preferably assisted by a light drive fit between the projection 52 and the mating opening 50. As shown in FIGS. 1 and 4, a weld 53 is applied in the space between weld surface 49 of the lower section 24 of the toeboard member 14 and the weld surface 46 of the spacer member 16 to strengthen the structural integrity of the toeboard system 10.

Although in the preferred embodiment of the present invention, one of the spacer members 16, 16', etc. is fastened to the toeboard member 14 by means of a projection 52 and a mating opening 50, it is within the scope of the present invention to utilize other means for fastening the spacer member 16 to the toeboard member 14. For example, the spacer member 16 and the toeboard member 14 could each be constructed without any projections or mating openings with the spacer member 16 being directly bolted or welded to the toeboard member 14. The present invention is intended to encompass all feasible methods of fastening the spacer member 16 to the toeboard member 14 and to include any additional elements required for such fastening means.

Preferably, the length of the toeboard member 14 and the length of the spacer member 16 are approximately equal, so that when the full length of the projection 52 of the space member 16 is disposed within the mating opening 50, a first side end 21 of toeboard member 14 is flush with a first side end 51 of the spacer member 16 and a second side end (not shown) of the toeboard member 14 is flush with a second side end (not shown) of the spacer member 16. However, it is within the scope of the present invention to construct toeboard member longer than spacer member 14 or to construct spacer member 16 longer than toeboard member 14. The present invention is intended to embrace all possible combinations of lengths of the toeboard members 14 and the spacer members 16 and all possible combinations of pluralities of the toeboard members 14 and the spacer members 16.

Referring to FIG. 4, the toeboard system 10 for a deckplate 12 optionally includes one or more reinforcing bars 67 attached at an end section 69 to the inboard side 58 of the spacer member 16 and disposed substantially perpendicular to the sidewall 28 of the central section 20 of the toeboard member 14. The one or more reinforcing bars 67 are attached at a second end (not shown) to a second toeboard system 10 (not shown) or to some other support structure associated with the deckplate 12, such as a truss member. The purpose of the one or more reinforcing bars 67 is to provide additional structural support to the toeboard system 10.

Referring to FIGS. 1 and 4, when the toeboard system 10 is combined with a deckplate 12, the deck opening 22 of the central section 24 of the toeboard member 14 is disposed about a side edge 13 of the deckplate 12, the lower deck contact surface 54 of the spacer member 16 abuts a bottom surface 17 of the deckplate 12 and the upper deck contact surface 26 of the upper section 18 of the toeboard member 14 abuts the top surface 15 of the deckplate 12. Further, the edge 13 of the deckplate 12 abuts the inner surface 29 of the sidewall 28 of the central section 20 of the toeboard member 14. The toeboard system 10 preferably extends longitudinally along the entire length of the deckplate 12 or several adjoining deckplates 12. However, it is within the scope of the present invention to extend the toeboard system 10 longitudinally along only a section of the length of the deckplate 12.

The toeboard system 10 is maintained disposed about a side edge 13 of the deckplate 12 by a friction fit between the deck opening 22 of the central section 20 of the toeboard member 14 and both the top surface 15 of the deckplate 12 and the bottom surface 17 of the deckplate 12. Preferably, a weld 61 is applied in the space between the weld surface 35 of the upper section 18 of the toeboard member 18 and the upper surface 15 of the deckplate 12 to strengthen the structural integrity of the toeboard system 10 and deckplate 12 combination. Furthermore, it is within the scope of the present invention to maintain the toeboard system 10 disposed about a side edge 13 of the deckplate 12 by other attachment means, such as by utilizing bolts or screws to fasten the toeboard member 14 to the deckplate 12.

Although the preferred embodiment of the present invention includes a spacer member 16 as described above, it is within the scope of the present invention to provide a toeboard system 10 which does not include a spacer member. In such an alternative toeboard system 10, the side edge 13 of the deckplate 12 would be disposed within the deck opening 22 of the central section 20 of the toeboard member 14, with only the ledge 42 of the central section 22 of the toeboard member 14 abutting a bottom surface 17 of the deckplate 12 and the upper deck contact surface 26 of the upper section 18 of the toeboard member 14 abutting the upper surface 15 of the deckplate 12.

Figure 5:
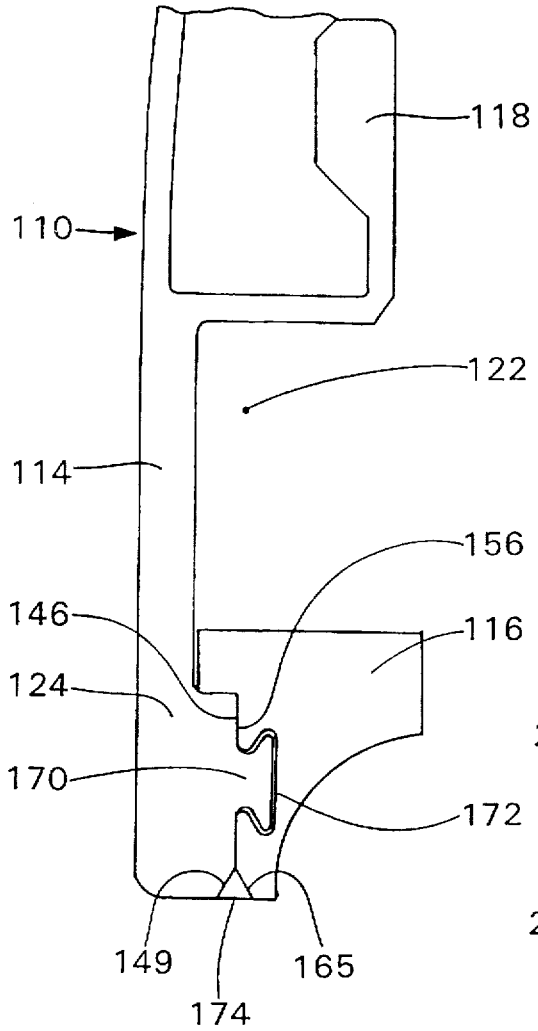
FIG. 5 is a partial cross-sectional view of a second preferred embodiment of the present invention having a mating opening on the spacer member and a mating projection on the toeboard member.

Referring now to FIG. 5, there is shown a second embodiment of a toeboard system 110 for a deckplate 112 in accordance with the present invention. The second embodiment of the toeboard system 110 is similar to the first preferred embodiment of the 10 described above, and like elements have been designated with the same numerals with the addition of 100. The differences from the first embodiment are described in detail below.

As shown in FIG. 5, the only differences between the second embodiment of the toeboard system 110 from the first embodiment of the toeboard system 10 concern the details of the elements for fastening the spacer member 116 to the toeboard member 114. The lower section 124 of the toeboard member 114 includes a projection 170 extending from an inboard surface 146. The projection 170 has a cross-section of a selected shape, preferably a dove-tail, and is sized to be received in and interlock with a mating opening 172 in the spacer member 116. The spacer member 116 includes a mating opening 172 which is disposed into the outboard side 156 of the spacer member 116. The mating opening 172 has a cross-section of a selected shape, preferably a dove-tail, and is sized to receive and interlock with the projection 170 of the lower section 124 of the toeboard member 114.

To fasten the spacer member 116 to the toeboard member 114, the two members are assembled so that the projection 170 of the lower section 124 of the toeboard member 114 is disposed with the mating opening 172 of the spacer member 116. More particularly, a side end of the projection 172 of the toeboard member 114 is placed into a side end of the mating opening 172 of the spacer member 170 and the spacer member is slidably displaced with respect to the toeboard member 114 so that the full length of the projection 170 of the toeboard member 114 is disposed within the mating opening 172 of the spacer member 116. The spacer member 116 is secured to the toeboard member 114 by the interlocking structure of the projection 170 of the lower section 124 of the toeboard member 114 disposed within the mating opening 172 of the spacer member 116, which is preferably assisted by a light drive fit between the projection 172 and the mating opening 170. Preferably, a weld 174 is applied in the space between the weld surface 149 of the lower section 124 of the toeboard member 114 and the weld surface 165 of the spacer member 116 to fixedly secure together the toeboard member 114 and the spacer member 116 and to strengthen the structural integrity of the toeboard system 110.

Figure 6:
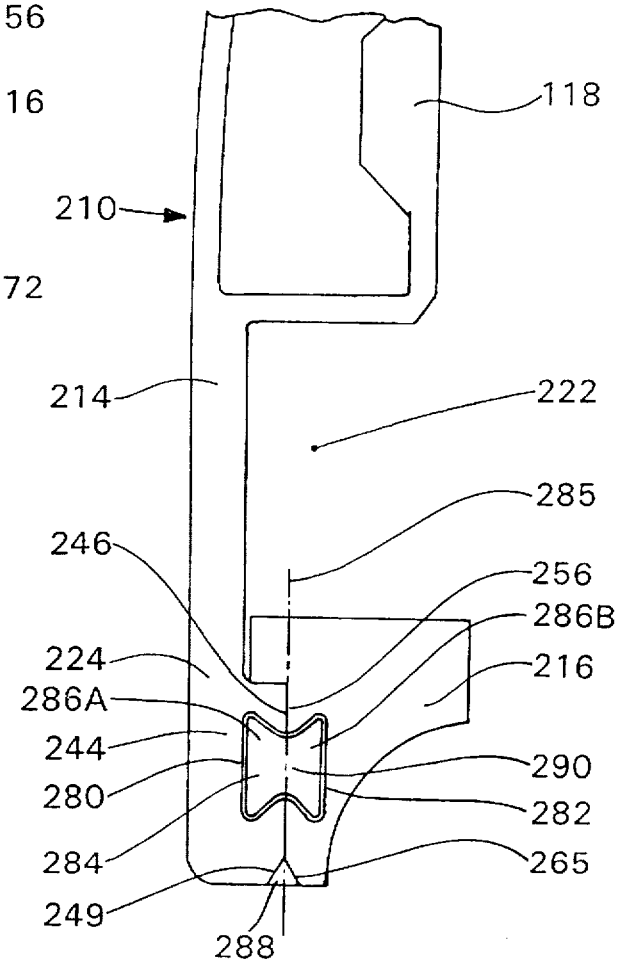
FIG. 6 is a partial cross-sectional view of a third preferred embodiment of the present invention including an interlocking member joining the spacer member to the toeboard member.

Referring now to FIG. 6, there is shown a third embodiment of a toeboard system 210 for a deckplate 212 in accordance with the present invention. The third embodiment of the toeboard system 210 is similar to the first preferred embodiment of the 10 described above, and like elements have been designated with the same numerals with the addition of 200. The differences from the first embodiment are described in detail below.

As shown in FIG. 6, the differences between the third embodiment of the toeboard system 210 from the first embodiment of the toeboard system 10 concern the details of the elements for fastening the spacer member 216 to the toeboard member 214. The toeboard member 214 includes a lower section 224 having a first mating opening 280 disposed into an inboard surface 246 of a sidewall 244 of the lower section 224. The first mating opening 280 has a cross-section of a selected shape, preferably a dove-tail, and is sized to receive and interlock with a projection. The spacer member 216 includes a second mating opening 282 disposed into an outboard side 256 of the spacer member 216. The second mating opening 282 has a cross-section of a selected shape, preferably a dove-tail, and is sized to receive and interlock with a projection. The toeboard system 210 further includes an interlocking member 284 which includes two projections 286A, 286B which extend from opposite sides of the interlocking member 284. The projection 286A has a cross-section of a selected shape, the shape of the first mating opening 280, and is sized to be received in and interlock with the first mating opening 280 in the lower section 224 of the toeboard member 214. The projection 286B has a cross-section of a selected shape, the shape of the second mating opening 282, and is sized to be received in and interlock with the second mating opening 282 in the spacer member 216. Preferably, the projections 286A and 286B are symmetrical with respect to a vertical centerline 285 of the interlocking member 284, as are the first mating opening 280 of the toeboard member 214 and the second mating opening 282 of the spacer member 216. With this preferred construction, the interlocking member 284 can be disposed between the spacer member 216 and the toeboard member 214 in one of two orientations of the interlocking member 284, the orientations being 180 degrees apart with respect to the centerline 285 of the interlocking member 284.

To fasten the spacer member 216 to the toeboard member 214, the two members are assembled so that the projection 286A or the projection 286B of the interlocking member 284 is disposed within the first mating opening 280 of the toeboard member 214 and the other of the two projections 286A, 286B is disposed within the second mating opening 282 of the spacer member 216, thereby joining the spacer member 216 with the toeboard member 214. The interlocking member 284 is disposed into the toeboard system 210 by inserting the interlocking member 284 simultaneously into the first mating opening 280 and the second mating opening 282 while the toeboard member 214 and the spacer member 216 are abutted or the interlocking member 284 is disposed into either of the mating openings 280, 282 of one of the members 214, 216 and then into the mating opening of the remaining member. The spacer member 216 is secured to the toeboard member 214 by the interlocking structure of one of the projections 286A or 286B of the interlocking member 284 disposed within the first mating opening 280 of the lower section 224 of the toeboard member 214 and the other projection 286A or 286B, respectively, disposed within the second mating opening 282 of the spacer member 216. The securement is preferably assisted by a light drive fit between the projections 286A, 286B and the particular mating openings in which each projection is disposed. Preferably, a weld 288 is applied in the space between the weld surface 249 of the lower section 224 of the toeboard member 214 and the weld surface 265 of the spacer member 216 to strengthen the structural integrity of the toeboard system 210.

The toeboard systems 10, 110 and 210 of the present invention have several advantages over prior art toeboard systems. One advantage is that the construction of the upper section 42 as a three-walled enclosed structure that extends over the deckplate is much stronger than a thin, solid straight-walled member extending above the surface of the deckplate. The upper section 18, 118, 218 of the toeboard member 14, 114, 214 of the present invention has a greater bending moment of inertia than a thin straight-walled member would have so that the upper section 18, 118, 218 of the toeboard member 14, 114, 214 can resist greater loading without bending and/or failing. The tapering or "triangle-like" configuration of the cross section of the upper section 18, 118, 218 of the toeboard member is stiffer in bending relative to a thin, straight, guard wall design while minimizing material by having a hollow cavity 36, 136, 236. Furthermore, by having an upper deck contact surface 26, 126, 226 which abuts the top surface 15, 115, 215 of the deckplate 12, 112, 212, the toeboard member 14, 114, 214 also resists bending of the deckplate 12, 112, 212 caused by vertical loading. Vertical loading on the deckplate 12, 112, 212 produces a bending moment that is exerted on the deckplate 12, 112, 212. This bending moment causes the edges 13, 113, 213 of the deckplate 12, 112, 212 to displace or attempt to displace in an upward direction. The upper deck contact surface 26, 126, 226 of the upper section 18, 118, 218 of toeboard system 14, 114, 214 counteracts the tendency of an edge 13, 113, 213 of the deckplate 12, 112, 212 to displace in an upward direction.

Another advantage of the toeboard system 10, 110, 210 of the present invention is that it can be used as the base of a toeboard-deckplate combination and can bear the loading on the deckplate or walkway structure. In prior art systems, the toeboard member supported loads applied only to the toeboard itself, such as, for example, the impact of a person's foot. In the present invention, the toeboard system 10, 110, 210 or components thereof can be utilized as load-bearing members to transfer any loading on the deckplate 12, 112, 212 to a truss system, end supports, directly to a floor surface or to any other walkway support structure.

A further advantage over many of the prior art toeboard systems is that the system can be utilized with a variety of deckplates of different thicknesses. By providing a plurality of spacer members of appropriate sizes, the deck opening 22, 122, 222 is adjusted to receive deckplates of various thicknesses. Although some of the toeboards of the prior art could be used with a deckplate of any size, these prior art designs were clearly incapable of accomplishing the other advantages as described above as these prior art designs were merely straight-walled members attached to the sides of a deckplate structure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A toeboard system for a deckplate, said toeboard system comprising:

(a) a longitudinally extending toeboard member comprising (i) an upper section having an upper deckplate contact surface being substantially flat;

(ii) a longitudinally extending inboard surface being substantially perpendicular to and intersecting with said upper deckplate contact surface and a longitudinally extending outboard surface being arcuate and convergent with said inboard surface at an edge of said upper section above said upper deckplate contact surface;

(iii) a central section having a longitudinally extending deckplate opening configured to receive a full length of a side edge of a deckplate said central section having a sidewall extending substantially perpendicular to said upper deckplate contact surface; and (iv) a lower section having a substantially flat base surface extending along a bottom edge of said lower section, and said lower section includes a longitudinally extending opening; and (b) a longitudinally extending spacer member having a lower deckplate contact surface and said spacer member being fastened to said toeboard member below said deckplate opening of said central section in said lower section opening of said toeboard member, wherein said spacer member extends over a full length of said toeboard member and said lower section opening of said toeboard member is a mating opening configured to receive a projection from said spacer member, said projection being disposed within said mating opening.

2. The toeboard system according to claim 1, wherein said mating opening has a cross-section of a selected shape and said projection has a cross-section of said selected shape and is sized to be received in and interlock with said mating opening.

3. The toeboard system according to claim 2, wherein said selected shape is a dove-tail.

4. The toeboard system according to claim 1, wherein said spacer member is selected from a plurality of spacer members of various sizes, each of said spacer members being sized to adjust a width of said deckplate opening of said central section of said toeboard member so that a distance between said lower deckplate contact surface of said spacer member and said upper deckplate contact surface of said upper section of said toeboard member is adapted to be approximately equal to a thickness of one of a variety of deckplates.

5. The toeboard system according to claim 1 in combination with a deckplate, said deckplate opening in said central section of said toeboard member being disposed about a side edge of said deckplate and said upper deckplate contact surface of said upper section of said toeboard member abutting an upper surface of said deckplate.

6. A combination comprising:

(a) a deckplate;

(b) a longitudinally extending toeboard member comprising (i) an upper section having an upper deckplate contact surface being substantially flat, (ii) a longitudinally extending inboard surface being substantially perpendicular to and intersecting with said upper deckplate contact surface and a longitudinally extending outboard surface being arcuate and convergent with said inboard surface at an edge of said upper section above said upper deckplate contact surface, (iii) a central section having a longitudinally extending deckplate opening along a side facing said deckplate and a sidewall extending substantially perpendicular to said upper deckplate contact surface, said deckplate opening receiving a full length of a side edge of said deckplate, and (iv) a lower section having a substantially flat base surface extending along a bottom edge of said lower section, and said lower section including a longitudinally extending opening; and (c) a longitudinally extending spacer member having a lower deckplate contact surface and being fastened to said toeboard member below said deckplate opening of said central section in said lower section opening of said toeboard member, wherein said spacer member extends over a full length of said toeboard member and said lower section opening of said toeboard member is a mating opening configured to receive a projection from said spacer member, said projection being disposed within said mating opening.

7. The combination according to claim 6, wherein loading on said deckplate is at least partially supported by said toeboard member.

* * * * *